US009905385B2

(12) United States Patent
Inaguchi et al.

(10) Patent No.: US 9,905,385 B2
(45) Date of Patent: Feb. 27, 2018

(54) ELECTROMAGNETIC SWITCH

(71) Applicant: Mitsubishi Electric Corporation, Tokyo (JP)

(72) Inventors: Takashi Inaguchi, Tokyo (JP); Sachiyo Kato, Tokyo (JP); Katsuki Hotta, Tokyo (JP); Tetsuya Yagi, Tokyo (JP)

(73) Assignee: Mitsubishi Electric Corporation, Chiyoda-ku, Tokyo (JP)

( * ) Notice: Subject to any disclaimer, the term of this patent is extended or adjusted under 35 U.S.C. 154(b) by 0 days.

(21) Appl. No.: 15/536,160

(22) PCT Filed: Dec. 24, 2014

(86) PCT No.: PCT/JP2014/006445
§ 371 (c)(1),
(2) Date: Jun. 15, 2017

(87) PCT Pub. No.: WO2016/103294
PCT Pub. Date: Jun. 30, 2016

(65) Prior Publication Data

US 2017/0358414 A1 Dec. 14, 2017

(51) Int. Cl.
*H01H 3/00* (2006.01)
*H01H 50/64* (2006.01)
(Continued)

(52) U.S. Cl.
CPC ..... *H01H 50/64* (2013.01); *H01H 50/18* (2013.01); *H01H 50/54* (2013.01)

(58) Field of Classification Search
CPC ..... H01H 67/02; H01H 9/20; H01H 63/00; H01H 51/06
(Continued)

(56) References Cited

U.S. PATENT DOCUMENTS 1,354,152 A * 9/1920 Whittaker ..... H01H 51/12 335/256
1,641,643 A * 9/1927 Petersen ..... H01H 71/42 335/65
(Continued)

FOREIGN PATENT DOCUMENTS

JP 62-154517 A 7/1987
JP 63-16518 A 1/1988
(Continued)

OTHER PUBLICATIONS

International Search Report for PCT/JP2014/006445 dated Mar. 24, 2015 [PCT/ISA/210].

*Primary Examiner* — Shawki S Ismail
*Assistant Examiner* — Lisa Homza
(74) *Attorney, Agent, or Firm* — Sughrue Mion, PLLC; Richard C. Turner

(57) ABSTRACT

According to an electromagnetic switch of the present invention, a crossbar operating in conjunction with a movable core slides in response to magnetization or demagnetization of an operating coil to cause attraction or separation between a fixed contact point and a movable contact point on the supply-side and between a fixed contact point and a movable contact point on the load-side. The electromagnetic switch further includes a first crossbar sliding part and a second crossbar sliding part, as well as a first casing sliding part and a second casing sliding part that allow the first and second crossbar sliding parts to slide. A contact between the first casing sliding part and the first crossbar sliding part or between the second casing sliding part and the second crossbar sliding part causes the crossbar on the side of the movable core to be tilted in a direction opposite to the direction of gravity with respect to the horizontal.

13 Claims, 12 Drawing Sheets

(51) Int. Cl.
*H01H 50/18* (2006.01)
*H01H 50/54* (2006.01)

(58) Field of Classification Search
USPC ..... 335/189
See application file for complete search history.

(56) References Cited

U.S. PATENT DOCUMENTS 1,676,466 A * 7/1928 Snavely ..... H01H 51/12 335/236
1,938,405 A * 12/1933 Tamsitt ..... H01H 51/12 335/181
2,687,502 A * 8/1954 Furnas ..... H01H 50/22 200/294
3,497,841 A * 2/1970 Marvin ..... H01H 51/01 335/179
3,740,650 A * 6/1973 Grenier ..... H01H 71/2436 335/239
4,978,874 A * 12/1990 Isozumi ..... F02N 15/046 310/71
5,019,739 A * 5/1991 Isozumi ..... F02N 15/046 310/233
5,023,581 A * 6/1991 Sugiyama ..... H01H 1/34 335/126
5,374,912 A * 12/1994 Houck, III ..... H01H 50/045 335/132
5,624,240 A * 4/1997 Kawaguchi ..... B60H 1/3222 417/222.2
6,411,184 B1 * 6/2002 Comtois ..... H01H 50/042 335/106
2007/0242408 A1 * 10/2007 Bergstrom ..... F01L 9/04 361/192
2009/0167470 A1 * 7/2009 Cusicanqui ..... H01H 51/2209 335/170
2013/0037517 A1 * 2/2013 Yuba ..... H01H 15/02 218/23

FOREIGN PATENT DOCUMENTS

JP 1-17795 Y2 5/1989
JP 7-37480 A 2/1995
JP 2012-9366 A 1/2012

* cited by examiner

ELECTROMAGNETIC SWITCH

CROSS REFERENCE TO RELATED APPLICATIONS

This application is a National Stage of International Application No. PCT/JP2014/006445, filed on Dec. 24, 2014, the contents of all of which are incorporated herein by reference in their entirety.

FIELD

The present invention relates to an electromagnetic switch.

BACKGROUND

In a conventional vertically-mounted electromagnetic switch, the weight of a movable part such as a movable core does not affect a restoring force of a back spring due to the influence of gravity. In a floor-mounted electromagnetic switch, the weight of the movable part acts against the force of the back spring and thus results in a failure of normal operation due to insufficient restoring force on the movable part. In a ceiling-mounted electromagnetic switch, the weight of the movable part is added in the direction of the force of the back spring contrary to the case of the floor-mounted electromagnetic switch, and results in a failure of normal operation due to an increase in the load force. Such a gravity problem can be mitigated by changing the set length of the back spring. The influence of gravity is thus compensated by increasing or decreasing the spring force in a mounting position in which the movable part is influenced by gravity. As a result, the restoring force or load force on the movable part can be adjusted to be equivalent to that of the vertically-mounted electromagnetic switch. A conventional technique performs the aforementioned adjustment of the length of the spring in the electromagnetic switch.

CITATION LIST

Patent Literature

Patent Literature 1: Japanese Patent Application Laid-Open No. H7-37480

SUMMARY

Technical Problem

According to the conventional technique, the adverse effect of gravity can be mitigated by changing the set length of a back spring. However, the movable core disposed on the side of a lower end of a crossbar causes the crossbar on the side of the movable core to be tilted in the direction of gravity from the horizontal by the influence of gravity. This causes load-side contact points to be closed after supply-side contact points are closed.

The present invention has been made in view of the above problem, where an object of the invention is to allow a movable core and a crossbar to operate in conjunction with each other to reduce a time lag between closing of load-side contact points and closing of supply-side contact points.

Solution to Problem

In order to solve the problems and achieve the object, according to an aspect of the present invention, there is provided an electromagnetic switch including: a movable core to be attracted to or separated from a fixed core by an electromagnet; a crossbar to include the movable core at an end and to slide integrally with the movable core in a direction of attraction or separation between the movable core and the fixed core; a casing sliding part to allow the crossbar to slide; a pair of movable contact points to operate in conjunction with sliding of the crossbar and be provided at positions to oppose each other with respect to a central axis of the crossbar along a sliding direction of the crossbar; and a pair of fixed contact points to be provided at positions facing the movable contact points, wherein the crossbar includes a first crossbar sliding part and a second crossbar sliding part, the casing sliding part includes a first casing sliding part to allow the first crossbar sliding part to slide, and a second casing sliding part to allow the second crossbar sliding part to slide, and the first crossbar sliding part is brought into contact with the first casing sliding part, or the second crossbar sliding part is brought into contact with the second casing sliding part to cause the crossbar on a side of the movable core to be tilted in a direction opposite to a direction of gravity with respect to the horizontal.

Advantageous Effects of Invention

The electromagnetic switch according to an embodiment of the present invention can slow down erosion of the load-side contact points with the reduced time lag between closing of the load-side contact points and closing of the supply-side contact points.

DESCRIPTION OF EMBODIMENTS

First Embodiment

A first embodiment of the present invention will now be described. Note that the present invention is not to be limited to the first embodiment.

Figure 1:
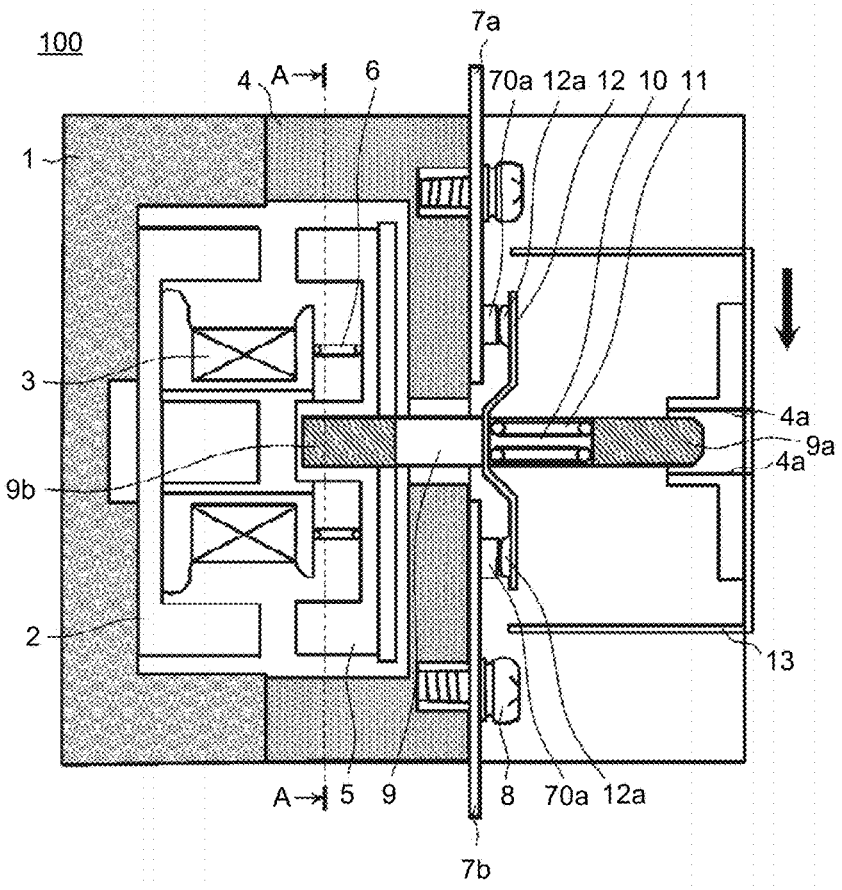
FIG. 1 is a sectional view illustrating a configuration of an electromagnetic switch according to a first embodiment of the present invention.

The configuration of an electromagnetic switch will be described with reference to FIGS. 1 to 5. FIG. 1 is a sectional view of an electromagnetic switch according to the first embodiment of the present invention as viewed laterally. Each component of an electromagnetic switch 100 will be described with reference to FIG. 1.

The electromagnetic switch 100 is provided. A mount 1 is formed of an insulating material. A fixed core 2 is fixed to the mount 1, formed by laminating a silicon steel plate, and substantially U-shaped. An operating coil 3 is disposed in a recess of the U-shaped fixed core 2. A casing 4 is fixed to the mount 1 and formed of an insulating material as with the mount 1. A movable core 5 is formed by laminating a silicon steel plate and substantially U-shaped, as with the fixed core 2. Protrusions of the U-shaped movable core 5 and fixed core 2 are disposed to face one another. A trip spring 6 is disposed between the operating coil 3 and the movable core 5. Note that the fixed core 2 and the movable core 5 are attracted to or separated from each other by an electromagnet.

A fixed contact 7 is attached to the casing 4. The fixed contact 7 includes a supply-side fixed contact 7*a* and a load-side fixed contact 7*b*. The fixed contact 7 includes a supply-side fixed contact point 70*a* joined to the supply-side fixed contact 7*a* and a load-side fixed contact point 70*b* joined to the load-side fixed contact 7*b*. A terminal screw 8 is used to connect the electromagnetic switch 100 to an external circuit. A crossbar 9 formed of an insulating material is disposed between the supply-side fixed contact 7*a* and the load-side fixed contact 7*b* and holds the movable core 5. A rectangular window 10 is provided to the crossbar 9. A pressing spring 11 is provided in the rectangular window 10.

A movable contact 12 is inserted into the rectangular window 10 of the crossbar 9 and held by the pressing spring 11. A supply-side movable contact point 12*a* is joined to the movable contact 12 located above the crossbar 9 with respect to the crossbar 9. A load-side movable contact point 12*b* is joined to the movable contact 12 located below the crossbar 9. The movable contact points 12*a* and 12*b* of the movable contact 12 are provided to face the corresponding fixed contact points 70*a* and 70*b* of the fixed contact 7. The supply-side movable contact point 12*a* comes into contact with the supply-side fixed contact point 70*a*, and the load-side movable contact point 12*b* comes into contact with the load-side fixed contact point 70*b* when a current passes through the contact points. Three pairs of the fixed contact 7 and the movable contact 12 are provided to correspond to phases of a three-phase alternating current of the electromagnetic switch 100. An arc cover 13 is provided to cover a top surface of the casing 4 so as to prevent discharging of an arc to the outside, the arc being generated at the time of separation between the supply-side fixed contact point 70*a* and the movable contact point 12*a*, and between the load-side fixed contact point 70*b* and the movable contact point 12*b*. An arrow indicates the direction of gravity.

The contact point disposed above a central axis of the crossbar 9 along the sliding direction thereof is the supply-side contact point, and the contact point disposed below the central axis is the load-side contact point.

Structured as described above, the crossbar 9 slides integrally with the movable core 5 in the direction of attraction or separation between the movable core 5 and the fixed core 2.

Structured as described above, the supply-side movable contact point 12*a* and the load-side movable contact point 12*b* are provided at positions to oppose each other with respect to the central axis of the crossbar 9 oriented in the sliding direction thereof, and move in conjunction with sliding of the crossbar 9. The supply-side movable contact point 12*a* and the load-side movable contact point 12*b* make up a pair of movable contact points.

The pair of the supply-side and load-side movable contact points 12*a* and 12*b* moves to be brought into contact with the supply-side fixed contact point 70*a* and the load-side fixed contact point 70*b*, respectively. The supply-side fixed contact point 70*a* and a load-side fixed contact point 70*b* make up a pair of fixed contact points.

As illustrated in FIG. 1, the crossbar 9 of the first embodiment includes a first crossbar sliding part and a second crossbar sliding part. A casing sliding part, by which the crossbar 9 is slided, includes a first casing sliding part allowing the first crossbar sliding part to slide, and a second casing sliding part allowing the second crossbar sliding part to slide. The first crossbar sliding part corresponds to a crossbar head sliding part 9*a*, and the second crossbar sliding part corresponds to a crossbar side wall sliding part 9*b*. The first casing sliding part corresponds to a casing head sliding part 4*a*, and the second casing sliding part corresponds to a casing wall sliding part 4*b* (not illustrated). The casing head sliding part 4*a* and a casing wall sliding part 4*b* are made of an insulating resin similar to that the casing 4 is made of. The insulating resin includes nylon, nylon 66, or nylon 46, for example. The crossbar head sliding part 9*a* and the crossbar side wall sliding part 9*b* are made of an insulating resin similar to that the crossbar is made of. The insulating resin includes a phenol resin, an unsaturated polyester resin, a melamine resin, or a urea resin, for example.

Figure 2:
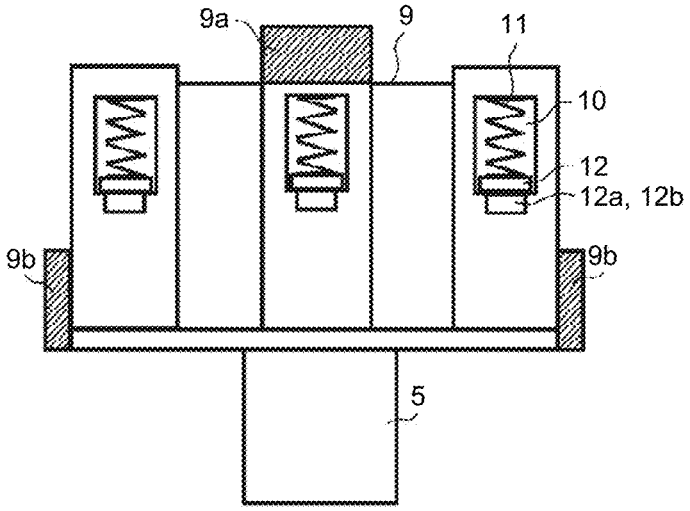
FIG. 2 is a view illustrating a movable part of the electromagnetic switch according to the first embodiment of the present invention.

FIG. 2 is a view illustrating a movable part of the electromagnetic switch 100. The movable part includes the movable core 5, the crossbar 9, the pressing spring 11, the movable contact 12, and the supply-side movable contact point 12*a* and the load-side movable contact point 12*b*. As illustrated in FIG. 2, the crossbar head sliding part 9*a* is provided on a head of the crossbar 9, and the crossbar side wall sliding part 9*b* is provided on a side wall of the crossbar 9. The pressing spring 11 disposed in the rectangular window 10 presses and holds the movable contact 12.

Figure 3:
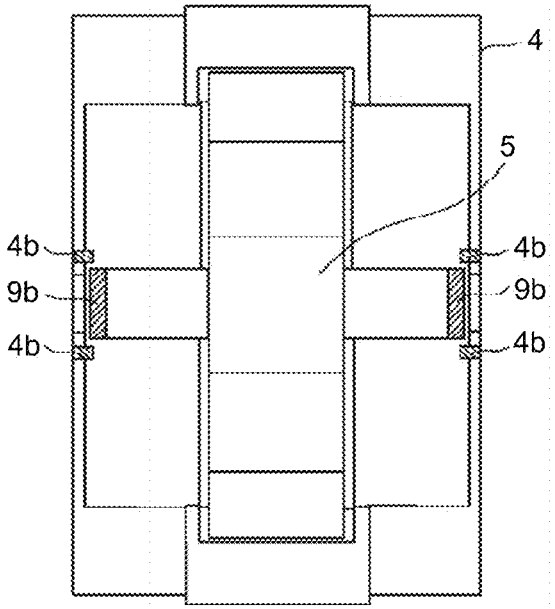
FIG. 3 is a view taken along section A-A of FIG. 1.

FIG. 3 is a view taken along section A-A of FIG. 1. As illustrated in FIG. 3, the casing wall sliding part 4*b* not illustrated in FIG. 1 is provided on a side wall of the casing 4 while corresponding to the position of the crossbar side wall sliding part 9*b*. The casing wall sliding part 4*b* is disposed to sandwich the crossbar side wall sliding part 9*b* from above and below the crossbar side wall sliding part.

Figure 4:
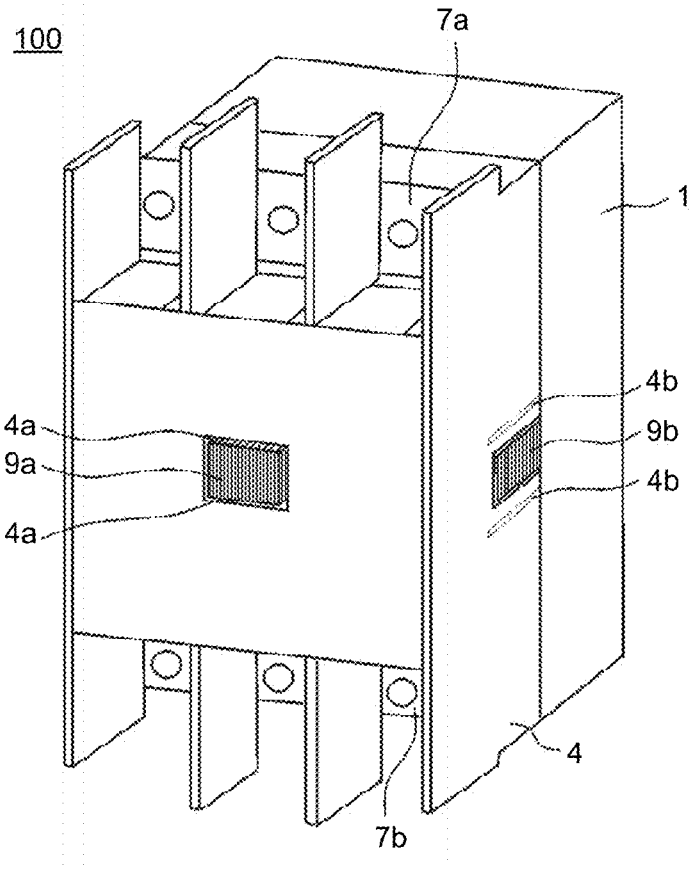
FIG. 4 is a front perspective view of the electromagnetic switch according to the first embodiment of the present invention.

FIG. 4 is a front perspective view of the electromagnetic switch 100. The casing head sliding part 4*a*, the casing wall sliding part 4*b*, the crossbar head sliding part 9*a*, and the crossbar side wall sliding part 9*b* are partially visible from the outside of the electromagnetic switch 100, as illustrated in FIG. 4.

The casing head sliding part 4*a* of the first embodiment is a pair of surfaces parallel to each other on a front surface of the casing 4. The casing wall sliding part 4*b* is a pair of rectangular parallelepiped protrusions parallel to each other on the side wall of the casing 4. The crossbar head sliding part 9*a* and the crossbar side wall sliding part 9*b* are each a part of the crossbar 9 and formed of a pair of parallel surfaces. The sliding part is not limited to a particular shape.

Figure 5:
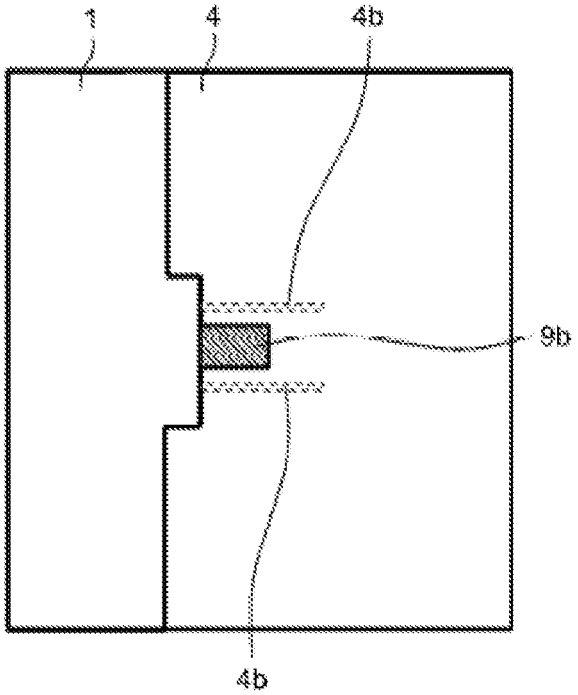
FIG. 5 is an external view of the electromagnetic switch as seen from the left.

FIG. 5 is a left external view of the electromagnetic switch 100 as seen from the left. One side of the crossbar side wall sliding part 9*b* is visible as illustrated in FIG. 5. A part indicated by a broken line is the casing wall sliding part 4*b* that is provided inside the casing 4 and not visible from the outside.

Figure 6:
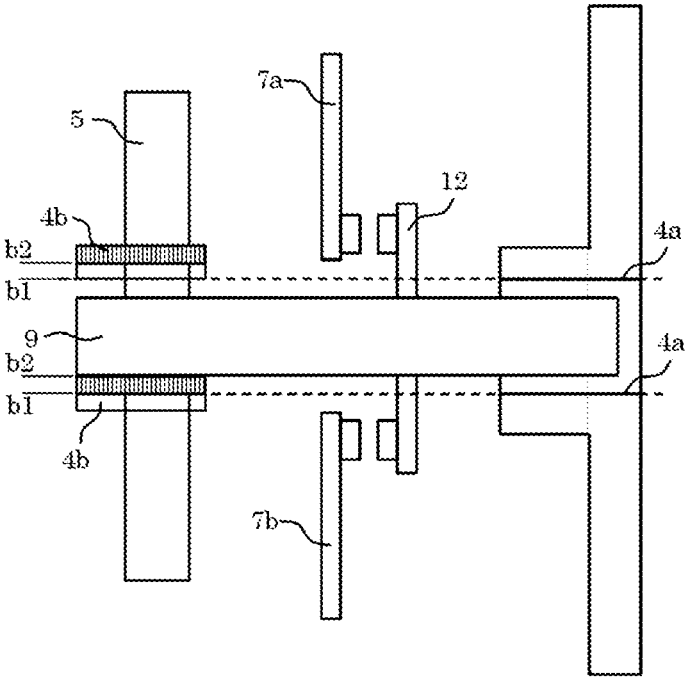
FIG. 6 is a conceptual view illustrating a movable part and a sliding part of an electromagnetic switch according to the first embodiment of the present invention where supply-side and load-side contact points of the electromagnetic switch are separated from each other.

FIG. 6 is a conceptual view illustrating the placement of the casing wall sliding part of the first embodiment. FIG. 6 illustrates an arrangement of the casing wall sliding part 4*b* of the electromagnetic switch 100 when the contact points are open, where the crossbar 9 is formed such that the top of the crossbar head sliding part 9*a* is flush with the top of the crossbar side wall sliding part 9*b* and that the bottom of the crossbar head sliding part 9*a* is flush with the bottom of the crossbar side wall sliding part 9*b*. In the first embodiment, when the supply-side and load-side contact points are closed, the casing wall sliding part 4*b* is brought into contact with the crossbar side wall sliding part 9*b* to cause the crossbar 9 on the side of the movable core 5 to be tilted in a direction opposite to the direction of gravity with respect to the horizontal. As illustrated in FIG. 6, the position of the casing wall sliding part 4*b* is shifted from b1 to b2, while the position of the casing head sliding part 4*a* is unchanged. In relative to the position of the casing head sliding part 4*a*, the casing wall sliding part 4*b* is now positioned higher than the position of the casing head sliding part 4*a*. Due to this, a contact timing of the load-side contact point becomes faster than that of the supply-side contact point.

A basic operation of the electromagnetic switch 100 will now be described with reference to FIG. 1.

FIG. 1 illustrates the electromagnetic switch 100 that is in an on state when the supply-side and load-side contact points are closed. An electromagnetic force generated by the passage of a current through the operating coil 3 in FIG. 1 causes the movable core 5 to be attracted to the fixed core 2 against the trip spring 6. At this time, the crossbar head sliding part 9*a* slides through the casing head sliding part 4*a*, and the crossbar side wall sliding part 9*b* slides through the casing wall sliding part 4*b*. This allows closing of the supply-side fixed contact point 70*a* and movable contact point 12*a* as well as closing of the load-side fixed contact point 70*b* and movable contact point 12*b* to switch the electromagnetic switch 100 to the on state. Interruption of the current through the operating coil 3 demagnetizes the electromagnet to cause the supply-side and load-side contact points to be opened, thereby switching the electromagnetic switch 100 to an off state.

Figure 7:
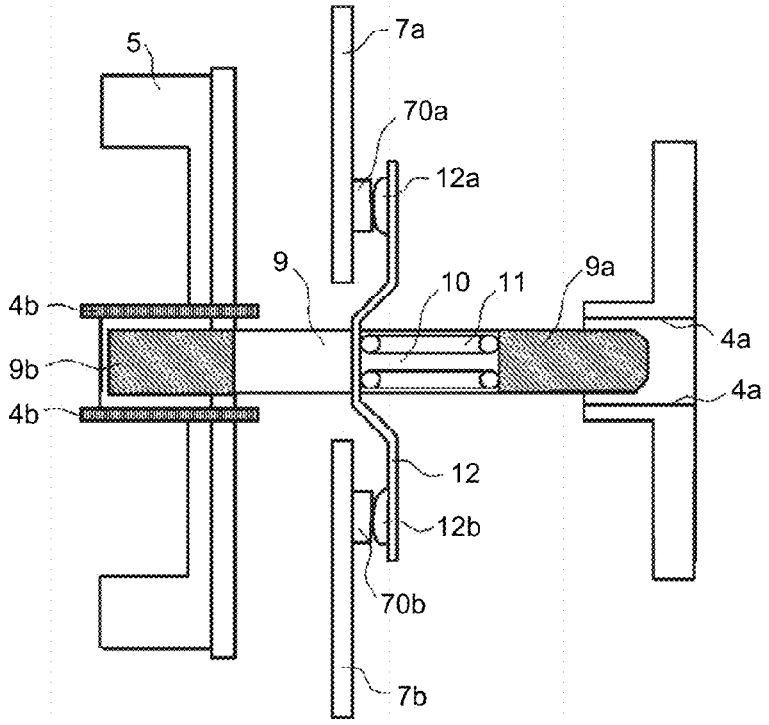
FIG. 7 is an enlarged view illustrating the movable part and the sliding part in an ideal state in closing the contact points of the electromagnetic switch, where both ends of a crossbar have the same height.
Figure 8:
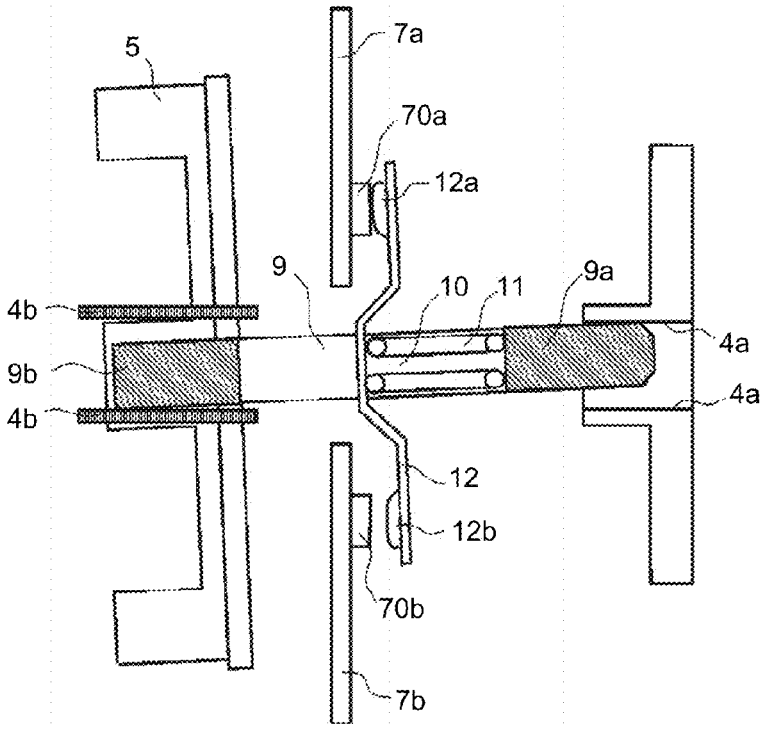
FIG. 8 is an enlarged view illustrating the movable part and the sliding part under the influence of gravity in closing the contact points of the electromagnetic switch, where both ends of the crossbar have the same height.

FIGS. 7 and 8 will now be referenced to describe an operation when the casing head sliding part 4*a* and the casing wall sliding part 4*b* are positioned at the same height relative to the crossbar sliding part of the crossbar 9.

FIG. 7 is an enlarged view illustrating the movable part and the sliding part in an ideal state in closing the supply-side and load-side contact points of the electromagnetic switch 100, where the casing head sliding part 4*a* and the casing wall sliding part 4*b* are positioned at the same height. When the electromagnetic switch 100 is in the on state as illustrated in FIG. 7, the crossbar head sliding part 9*a* is positioned in the center of the casing head sliding part 4*a*, and the crossbar side wall sliding part 9*b* is positioned in the center of the casing wall sliding part 4*b*. The current flows since the supply-side fixed contact point 70*a* and the load-side fixed contact point 70*b* are in contact with the supply-side movable contact point 12*a* and the load-side movable contact point 12*b*, respectively.

Note that the crossbar 9 and the casing 4 are each made of the insulating resin and thus expand under the influence of humidity and temperature. A gap is provided between the crossbar head sliding part 9*a*, which is not locked at the time of sliding and thus slides smoothly, and the casing head sliding part 4*a* and between the crossbar side wall sliding part 9*b* and the casing wall sliding part 4*b*. The dimension of the gap may be 0.1 to 1 mm, for example, but is not limited thereto.

With the gap being provided and by the influence of gravity, the crossbar head sliding part 9*a* and the crossbar side wall sliding part 9*b* are not positioned in the centers of the corresponding casing head sliding part 4*a* and casing wall sliding part 4*b* as illustrated in FIG. 7.

FIG. 8 is an enlarged view illustrating the movable part and the sliding part of the electromagnetic switch 100 under the influence of gravity in closing the supply-side and load-side contact points of the electromagnetic switch 100, where the casing head sliding part 4*a* and the casing wall sliding part 4*b* are positioned at the same height. When the contact points are closed as illustrated in FIG. 8, the weight of the movable core 5 under the influence of gravity causes the crossbar 9 on the side of the movable core 5 to be tilted in the direction of gravity with respect to the horizontal. This causes the movable contact 12 held on the crossbar 9 by the pressing spring 11 to be tilted so that the supply-side movable contact point 12*a* is electrically connected to the supply-side fixed contact point 70*a* first, and thereafter the load-side movable contact point 12*b* is electrically connected to the load-side fixed contact point 70*b*.

The movable contact points 12*a* and 12*b* collide with the corresponding fixed contact points 70*a* and 70*b* when the contact points are brought into contact with each other. At the time of collision, the movable contact points 12*a* and 12*b* bounce back as a result of the collision. The supply-side movable contact point 12*a* has a higher contact pressure by the pressing spring 11 than the load-side movable contact point 12*b* since the supply-side movable contact point 12*a* is connected to the supply-side fixed contact point 70*a* first. A counterclockwise moment is likely to act on the crossbar 9 by the weight of the movable core 5. Thus, the contact pressure of the supply-side movable contact point 12*a* becomes higher and the contact pressure of the load-side movable contact point 12*b* becomes lower.

The above factor reduces the contact pressure of the load-side movable contact point 12*b* and increases the contact pressure of the supply-side movable contact point 12*a*. As a result, the load-side movable contact point 12*b* bounces more easily and floats in the air longer than the supply-side movable contact point 12*a*. The load-side contact points are subjected to arc erosion due to an arc current flowing while the load-side movable contact point 12*b* floats in the air. The load-side movable contact point 12*b* and the load-side fixed contact point 70*b* are thus more prone to erosion than the supply-side movable contact point 12*a* and the supply-side fixed contact point 70*a*.

In order to prevent acceleration of such contact erosion, the structure illustrated in FIG. 6 is adopted to close the load-side contact points of the electromagnetic switch 100 before closing the supply-side contact points.

The operations, functions, and effects will be described with reference to FIGS. 9 and 10.

Figure 9:
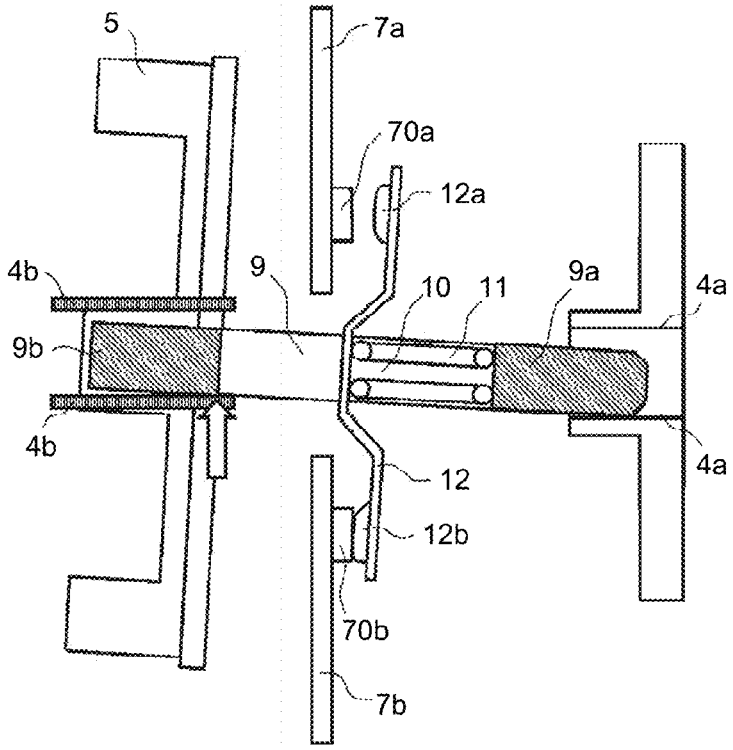
FIG. 9 is an enlarged view illustrating the movable part and the sliding part in closing the contact points of the electromagnetic switch according to the first embodiment of the present invention.

FIG. 9 is an enlarged view illustrating the movable part and the sliding part in closing the supply-side and load-side contact points of the electromagnetic switch 100, according to the first embodiment. As illustrated in FIG. 9, the casing wall sliding part 4*b* corresponding to the crossbar side wall sliding part 9*b* is disposed at a position higher than the casing head sliding part 4*a* in the direction opposite to the direction of gravity of the crossbar 9 in order for the crossbar side wall sliding part 9*b* to slide in the direction opposite to the direction of gravity with respect to the horizontal. An arrow in FIG. 9 indicates the reaction of the bottom surface of the casing wall sliding part 4*b*. This reaction allows the crossbar side wall sliding part 9*b* to be held at the position tilted in the direction opposite to the direction of gravity.

Figure 10:
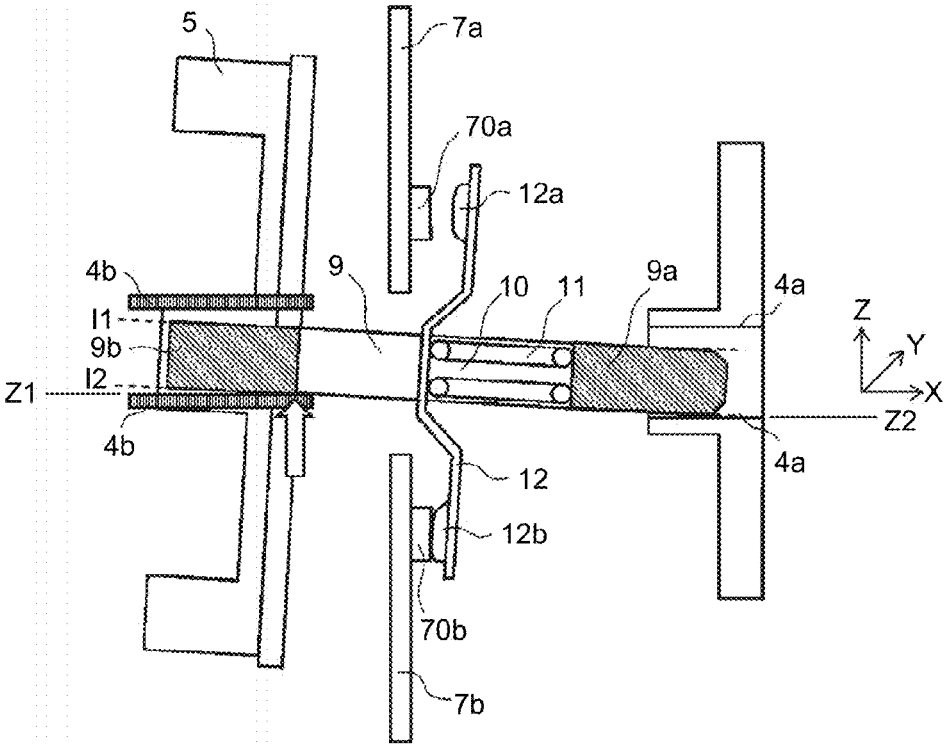
FIG. 10 is an enlarged view illustrating the movable part and the sliding part in closing the contact points of the electromagnetic switch according to the first embodiment of the present invention.

FIG. 10 is a schematic enlarged view illustrating the position of the casing wall sliding part 4*b* illustrated in FIG. 9. A Z axis corresponds to the direction opposite to the direction of gravity, as illustrated in FIG. 10. The top surface of the crossbar head sliding part 9*a* lies on the same plane I1 as the top surface of the crossbar side wall sliding part 9*b*. The bottom surface of the crossbar head sliding part 9*a* lies on the same plane I2 as the bottom surface of the crossbar side wall sliding part 9*b*. It is assumed that the two planes I1 and I2 are parallel to each other.

Where Z1 is the position of the casing wall sliding part 4*b* corresponding to the bottom of the crossbar side wall sliding part 9*b* and Z2 is the position of the casing head sliding part 4*a* corresponding to the bottom of the crossbar head sliding part 9*a*, the position Z1 is higher than the position Z2. A difference between the positions Z1 and Z2 is 0.1 mm, for example, meaning the position Z1 is higher than the position Z2 by 0.1 mm.

The casing wall sliding part 4*b* is positioned as described above to allow the load-side movable contact point 12*b* to be electrically connected to the load-side fixed contact point 70*b* first, and thereafter allow the supply-side movable contact point 12*a* to be electrically connected to the supply-side fixed contact point 70*a*. The current starts flowing as a result.

When the contact points are brought into contact with each other as illustrated in FIG. 9 or 10, the movable contact points 12*a* and 12*b* bounce back upon colliding with the fixed contact points 70*a* and 70*b*. At this time, the load-side movable contact point 12*b* is electrically connected to the load-side fixed contact point 70*b* first and thus has the higher contact pressure by the pressing spring 11 than the supply-side movable contact point 12*a*. On the other hand, as illustrated in FIG. 8, the movable core 5 disposed on the side of the side wall of the crossbar 9 is likely to cause a counterclockwise moment by the weight of the movable core 5 to thus result in an increase in the contact pressure of the supply-side movable contact point 12*a* and a decrease in the contact pressure of the load-side movable contact point. As a result of these actions, the contact pressures of the supply-side contact point and the load-side contact point are balanced out to allow the supply-side contact point and the load-side contact point to be more likely to exert equal contact pressure.

The supply-side movable contact point 12*a* and the load-side movable contact point 12*b* bounce equally as described above to thus be subjected to erosion substantially equally. As a result, a closing timing of the supply-side contact points is substantially same as that of the load-side contact points, and thus extreme erosion of the electrodes can be prevented.

Figure 11:
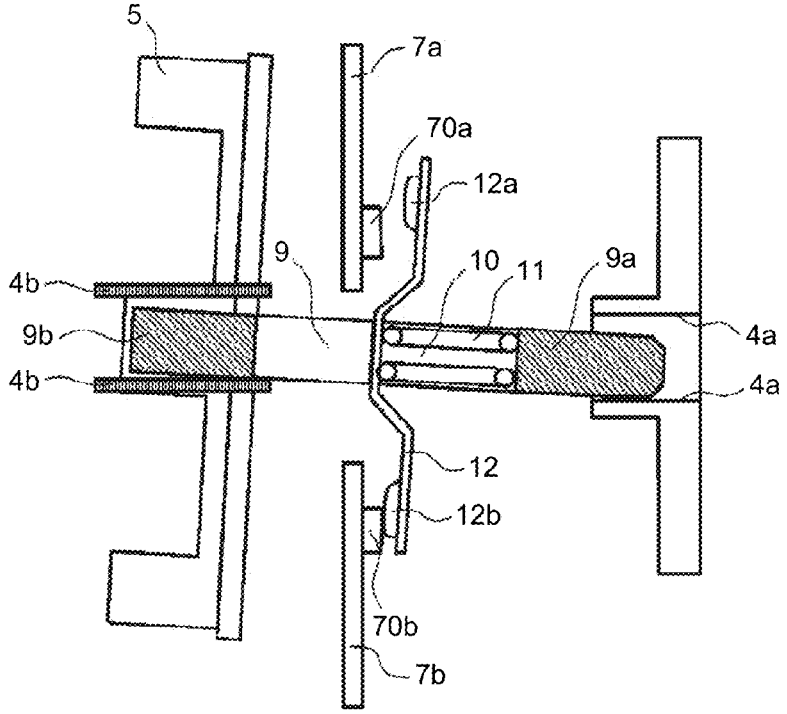
FIG. 11 is an enlarged view illustrating the movable part and the sliding part where positions of the contact points of the electromagnetic switch are shifted in closing the contact points, according to the first embodiment of the present invention.

The placement of the casing wall sliding part 4*b* as illustrated in FIG. 9 of the first embodiment may, however, cause the supply-side movable contact point 12*a* to be positioned higher than the supply-side fixed contact point 70*a* and the load-side movable contact point 12*b* higher than the load-side fixed contact point 70*b* as illustrated in FIG. 11 at the time of closing of the supply-side and load-side contact points. In this case, lower sides of the movable contact points 12*a* and 12*b* are brought into contact with upper sides of the corresponding fixed contact points 70*a* and 70*b*, thereby causing erosion in and around the area of contact.

In order to prevent partial erosion of the contact points, the positions of the contact points are adjusted as illustrated in FIG. 7 such that the positions of the movable contact points 12*a* and 12*b* are not shifted vertically with respect to the positions of the corresponding fixed contact points 70*a* and 70*b* in closing the contact points of the electromagnetic switch 100. Regarding adjustment of the contact points, the positions of the contact points are adjusted such that centers of the fixed contact point and the corresponding movable contact point are aligned when the movable core 5 is attracted to the fixed core 2. When the fixed contact point and the movable contact point have different areas of contact, for example, the contact points are positioned such that the contact point having the smaller area does not lie outside the contact point having the larger area at the time of closing the contact points.

According to the first embodiment, owing to the placement of the casing wall sliding part 4*b*, the contact timing of the supply-side contact points is substantially same as that of load-side contact points, and thus the life of the electromagnetic switch can be extended.

Although the structure and arrangement of the first embodiment have been described, the first embodiment is not limited to the aforementioned structure and arrangement.

Figure 12:
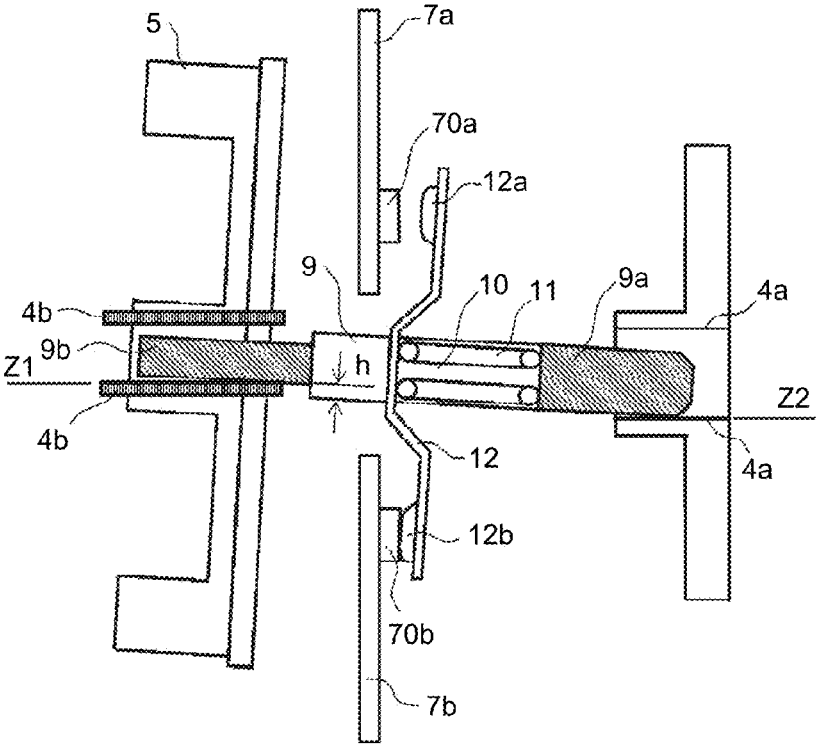
FIG. 12 is an enlarged view illustrating the movable part and the sliding part in closing the contact points of the electromagnetic switch, where the crossbar according to the first embodiment of the present invention has a different shape.

As illustrated in FIG. 12, for example, the shape of the crossbar 9 can be different from the shape of the crossbar 9 in FIG. 10, in which case the top surface of the crossbar head sliding part 9*a* is not flush with the top surface of the crossbar side wall sliding part 9*b*, and the bottom surface of the crossbar head sliding part 9*a* is not flush with the bottom surface of the crossbar side wall sliding part 9*b*. In such a case, a difference in height between the bottom surface of the crossbar head sliding part 9*a* and the bottom surface of the crossbar side wall sliding part 9*b* equals h, and thus Z1 is positioned higher than Z2+h. A difference between Z1 and Z2+h is 0.1 mm, for example. An effect similar to the aforementioned effect can be obtained with such setting.

The change in the shape of the crossbar 9 causes the change in the position of the casing wall sliding part 4*b* as described above. The casing wall sliding part 4*b* thus controls the crossbar side wall sliding part 9*b* on the side of the movable core 5 to be tilted in the direction opposite to the direction of gravity with respect to the horizontal.

An effect similar to the aforementioned effect can also be obtained with the structure of the first embodiment by increasing the thickness of the casing wall sliding part 4*b* on the load-side. The thickness is increased to the height similar to the position to which the casing wall sliding part is shifted in FIG. 10. The casing wall sliding part 4*b* is thus brought into contact with the crossbar side wall sliding part 9*b* to cause the crossbar 9 on the side of the movable core 5 to be tilted in the direction opposite to the direction of gravity with respect to the horizontal. Alternatively, the casing wall sliding part 4*b* and the crossbar side wall sliding part 9*b* are brought into contact with each other to counteract the tilt of the crossbar 9 caused by gravity acting thereon.

Second Embodiment

A second embodiment of the present invention will now be described with reference to FIGS. 13 to 17, each of which is an enlarged view illustrating the structure and operation of an electromagnetic switch 100 installed such that a direction of attraction or separation between a movable core 5 and a fixed core 2 is perpendicular to gravity. A component common to the first and second embodiments will be designated by the same reference numeral and described.

As with the first embodiment, a casing sliding part of the second embodiment controls a crossbar 9 to move in a direction opposite to the direction of gravity in the process of closing of supply-side and load-side contact points. Note that the casing wall sliding part 4*b* is shifted in the direction opposite to the direction of gravity in the first embodiment, whereas a casing head sliding part 4*a* is shifted in the direction of gravity in the second embodiment.

Figure 13:
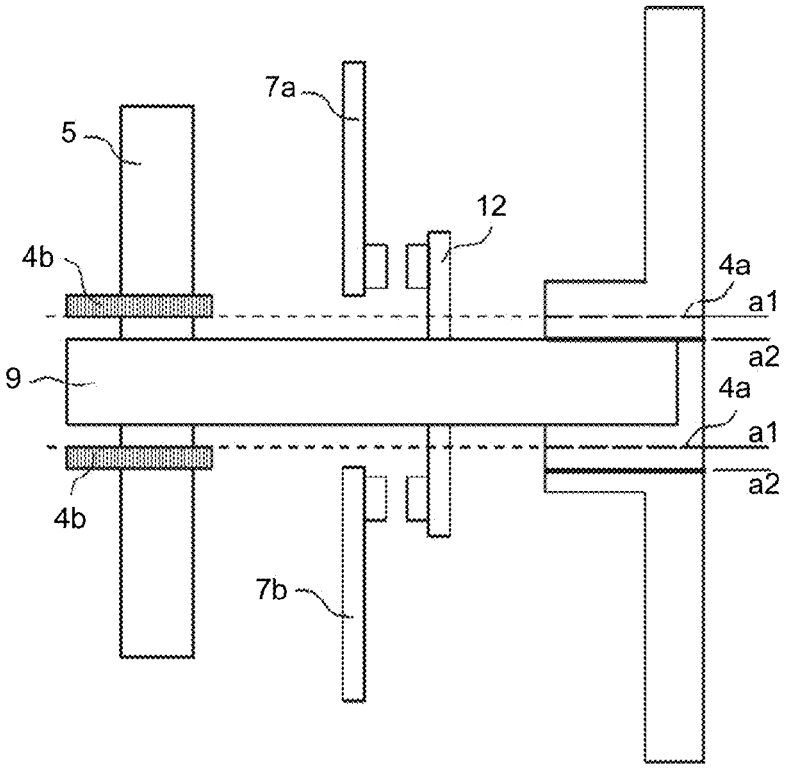
FIG. 13 is a conceptual view illustrating a movable part and a sliding part of an electromagnetic switch according to a second embodiment of the present invention where supply-side and load-side contact points of the electromagnetic switch are separated from each other.

FIG. 13 is a conceptual view illustrating the arrangement of the casing head sliding part 4*a* of the second embodiment when supply-side and load-side contact points of the electromagnetic switch 100 are not in contact with each other. FIG. 13 illustrates the structure of the second embodiment in which the position of the casing head sliding part 4*a* is shifted from a horizontal plane a1 to a horizontal plane a2 perpendicular to the direction of gravity of the crossbar 9 and the position of a casing wall sliding part 4*b* is not changed. The casing head sliding part 4*a* is positioned lower than the position of the casing wall sliding part 4*b*.

Figure 14:
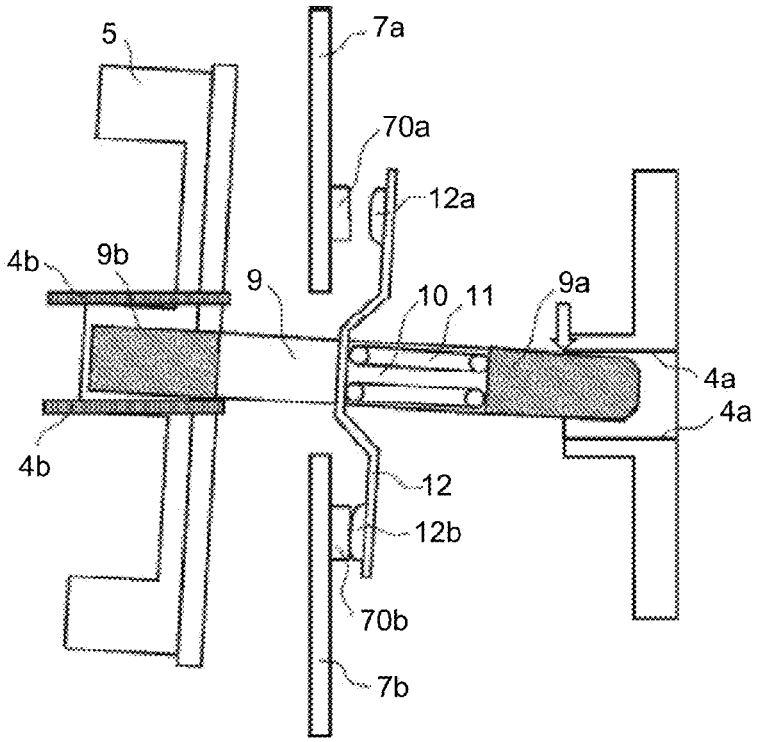
FIG. 14 is an enlarged view illustrating the movable part and the sliding part in closing the contact points of the electromagnetic switch according to the second embodiment of the present invention.

FIG. 14 is the enlarged view illustrating a movable part and a sliding part of the second embodiment in closing the supply-side and load-side contact points of the electromagnetic switch 100. An arrow in FIG. 14 indicates the reaction exerted on a crossbar head sliding part 9*a* from a top surface of the casing head sliding part 4*a*. This reaction causes the crossbar head sliding part 9*a* to be tilted in the direction of gravity. FIG. 14 illustrates the structure in which the position of the casing head sliding part 4*a* is shifted in the direction of gravity.

Figure 15:
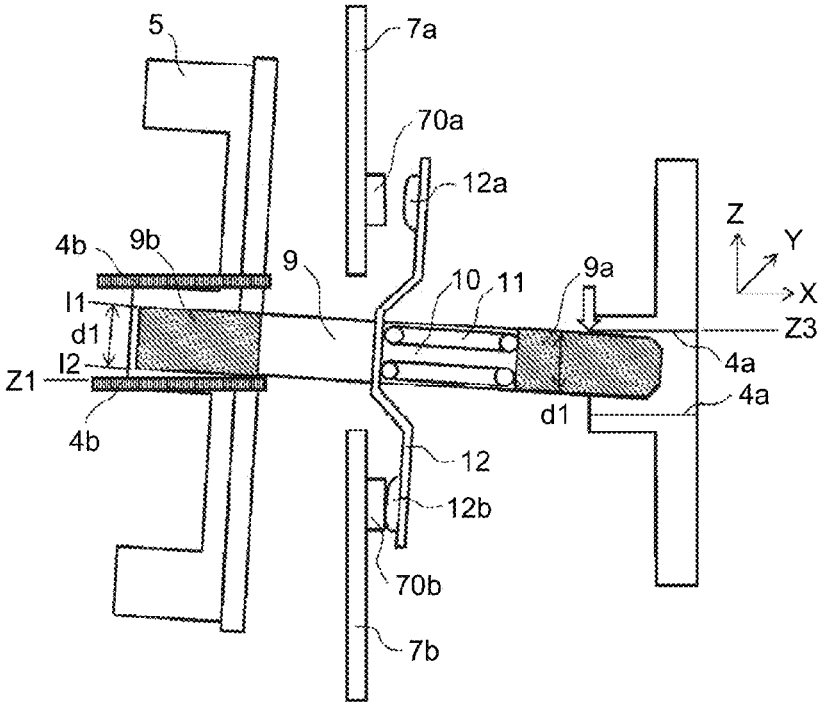
FIG. 15 is an enlarged view illustrating the movable part and the sliding part in closing the contact points of the electromagnetic switch according to the second embodiment of the present invention.

FIG. 15 is the enlarged view illustrating the position of the casing head sliding part 4*a* illustrated in FIG. 14. A Z axis corresponds to the direction opposite to the direction of gravity, as illustrated in FIG. 15. The top of the crossbar head sliding part 9*a* lies on the same plane I1 as the top of a crossbar side wall sliding part 9*b*, and the bottom of the crossbar head sliding part 9*a* lies on the same plane I2 as the bottom of the crossbar side wall sliding part 9*b*. It is assumed that the two planes I1 and I2 are parallel to each other, and that the crossbar head sliding part 9*a* and the crossbar side wall sliding part 9*b* have the same thickness d1. A position Z1 corresponds to the bottom of the casing wall sliding part 4*b* corresponding to the bottom of the crossbar side wall sliding part 9*b*, and a position Z3 corresponds to the top of the casing head sliding part 4*a* corresponding to the top of the crossbar head sliding part 9*a*. The value of Z3 is smaller than the sum of Z1 and d1. A subtraction of the value of Z3 from the sum of Z1 and d1 gives 0.1 mm, for example.

The casing head sliding part 4*a* is positioned as described above to allow a load-side movable contact point 12*b* to be electrically connected to a load-side fixed contact point 70*b* first, and thereafter allow a supply-side movable contact point 12*a* to be electrically connected to a supply-side fixed contact point 70*a*, by which a current starts flowing as a result.

The load-side movable contact point 12*b* is electrically connected to the load-side fixed contact point 70*b* first and thus has a higher contact pressure due to a pressing spring 11 than the supply-side movable contact point 12*a*. On the other hand, as illustrated in FIG. 8, the movable core 5 disposed on the side of a side wall of the crossbar 9 is likely to cause a counterclockwise moment due to the weight of the movable core 5, thus resulting in an increase the contact pressure of the supply-side movable contact point 12*a* and a decrease in the contact pressure of the load-side movable contact point 12*b*. As a result of these actions, the contact pressures of the supply-side contact point and the load-side contact point are balanced out to allow the supply-side contact point and the load-side contact point to be more likely to exert equal contact pressure.

The supply-side movable contact point 12*a* and the load-side movable contact point 12*b* thus bounce equally to be subjected to erosion substantially equally.

Figure 16:
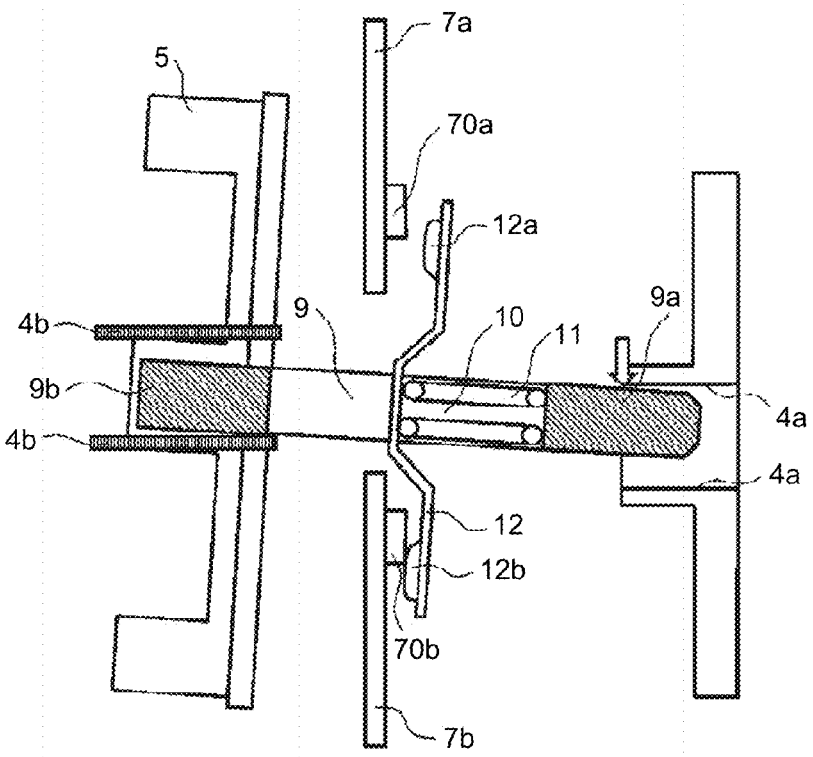
FIG. 16 is an enlarged view illustrating the movable part and the sliding part where positions of the contact points of the electromagnetic switch are shifted in closing the contact points, according to the second embodiment of the present invention.

The placement of the casing head sliding part 4*a* of the second embodiment may, however, cause the supply-side movable contact point 12*a* to be positioned lower than the supply-side fixed contact point 70*a* and the load-side movable contact point 12*b* lower than the load-side fixed contact point 70*b* as illustrated in FIG. 16. In this case, upper parts of the movable contact points 12*a* and 12*b* are brought into contact with lower parts of the corresponding fixed contact points 70*a* and 70*b*, thereby causing erosion in and around the area of contact. The contact points being partially subjected to erosion, the positions of the contact points are adjusted as illustrated in FIG. 7 such that the positions of the movable contact points 12*a* and 12*b* are not shifted vertically with respect to the positions of the corresponding fixed contact points 70*a* and 70*b* in closing the contact points of the electromagnetic switch 100. As with the first embodiment, the positions of the contact points are adjusted such that centers of the fixed contact point and the corresponding movable contact point are aligned when the movable core 5 is attracted to the fixed core 2.

Figure 17:
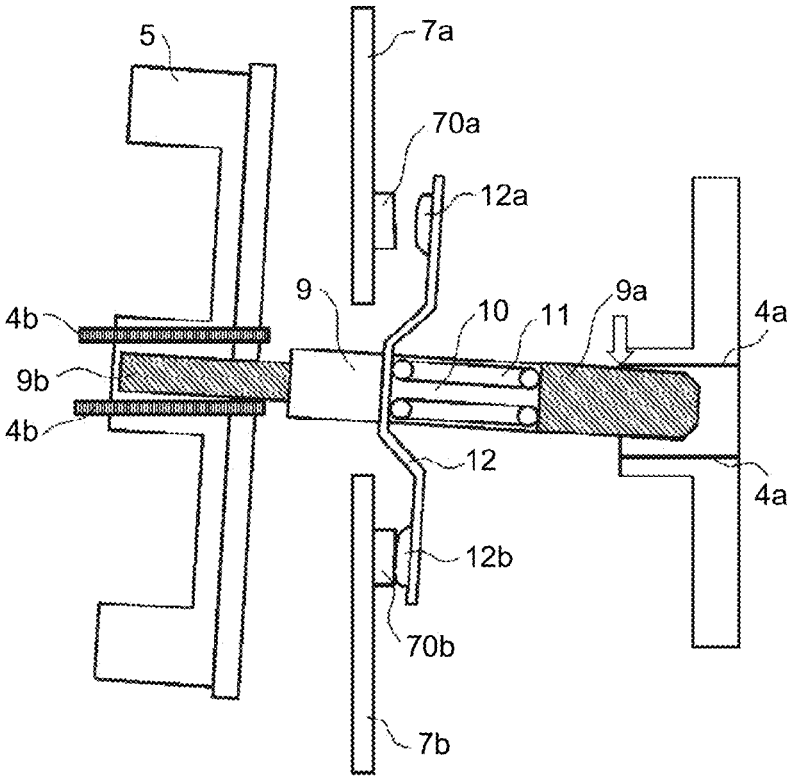
FIG. 17 is an enlarged view illustrating the movable part and the sliding part in closing the contact points of the electromagnetic switch, where the crossbar according to the second embodiment of the present invention has a different shape.

The second embodiment can obtain an effect similar to that of the first embodiment. As illustrated in FIG. 17, on the other hand, the crossbar 9 can have different shapes on both ends, in which case the top surface of the crossbar head sliding part 9*a* is not flush with the top surface of the crossbar side wall sliding part 9*b*, and the bottom surface of the crossbar head sliding part 9*a* is not flush with the bottom surface of the crossbar side wall sliding part 9*b*. In this case, the casing head sliding part 4*a* is positioned to control the crossbar head sliding part 9*a* to be tilted in the direction of gravity with respect to the horizontal, whereby the effect similar to the aforementioned effect can be obtained.

The effect similar to the aforementioned effect can also be obtained with the structure of the second embodiment by increasing the thickness of the casing head sliding part 4*a* on the supply-side. According to the first and second embodiments, the casing wall sliding part 4*b* is brought into contact with the crossbar side wall sliding part 9*b*, or the casing head sliding part 4*a* is brought into contact with the crossbar head sliding part 9*a*, thereby causing the crossbar 9 on the side of the movable core 5 to be tilted in the direction opposite to the direction of gravity with respect to the horizontal. Alternatively, the casing wall sliding part 4*b* is brought into contact with the crossbar side wall sliding part 9*b* or the casing head sliding part 4*a* is brought into contact with the crossbar head sliding part 9*a* to counteract the tilt of the crossbar 9 caused by gravity acting thereon.

Third Embodiment

Figure 18:
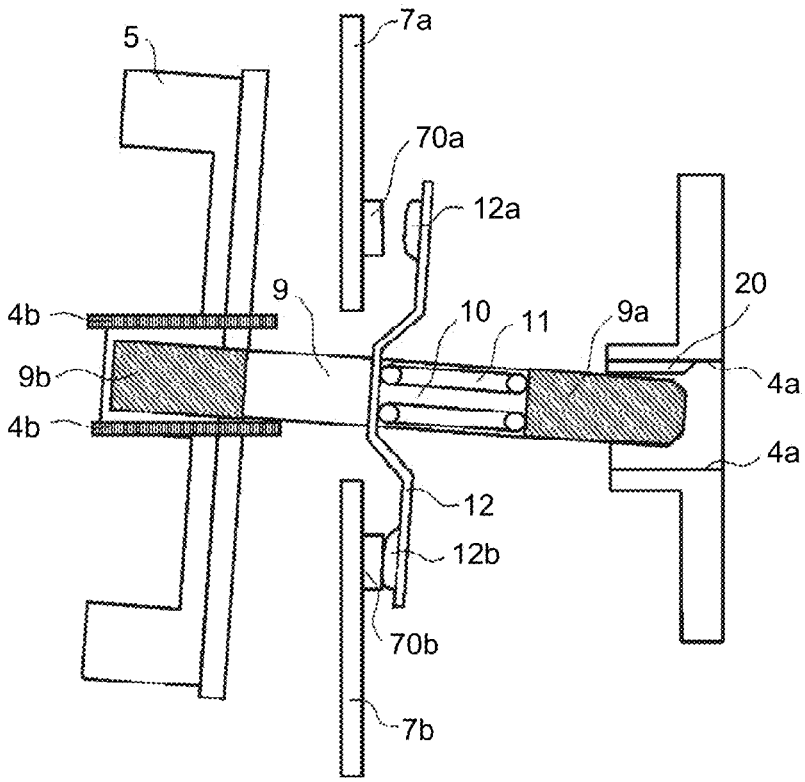
FIG. 18 is an enlarged view illustrating a movable part and a sliding part in closing contact points of an electromagnetic switch according to a third embodiment of the present invention.

A third embodiment of the present invention will now be described with reference to FIG. 18. A component common to the second and third embodiments will be designated by the same reference numeral and described.

In the third embodiment, a protrusion 20 is provided in an upper part of a casing head sliding part 4*a* facing a crossbar head sliding part 9*a* along the sliding direction of a crossbar 9. The protrusion 20 is provided in the upper part of the casing head sliding part 4*a* facing the crossbar head sliding part 9*a* as illustrated in FIG. 18, thereby shifting the position of the casing head sliding part 4*a* in the direction of gravity. This causes the crossbar to slide with the crossbar head sliding part 9*a* being tilted in the direction of gravity and a crossbar side wall sliding part 9*b* being tilted in a direction opposite to the direction of gravity.

The protrusion 20 may be provided on a wall of the casing head sliding part 4*a* and plate-shaped. Alternatively, the protrusion 20 may be integrated with a casing 4.

The placement of the protrusion 20 according to the third embodiment may cause a supply-side movable contact point 12*a* to be positioned lower than a supply-side fixed contact point 70*a* and a load-side movable contact point 12*b* lower than a load-side fixed contact point 70*b* as illustrated in FIG. 16. In this case, upper parts of the movable contact points 12*a* and 12*b* are brought into contact with lower parts of the corresponding fixed contact points 70*a* and 70*b*, thereby causing erosion in and around the area of contact. The contact points being partially subjected to erosion, the positions of the contact points are adjusted as illustrated in FIG. 7 such that the positions of the movable contact points 12*a* and 12*b* are not shifted vertically with respect to the positions of the corresponding fixed contact points 70*a* and 70*b* in closing the contact points of an electromagnetic switch 100.

The third embodiment can obtain an effect similar to that of the second embodiment.

A protrusion 20 can also be provided in a lower part of a casing wall sliding part 4*b* facing the crossbar side wall sliding part 9*b* along the sliding direction of the crossbar 9. Such protrusion causes the casing wall sliding part 4*b* to be shifted in the direction opposite to the direction of gravity, thereby causing the crossbar head sliding part 9*a* to be tilted in the direction of gravity and the crossbar side wall sliding part 9*b* in the direction opposite to the direction of gravity to be able to obtain the same effect as that of the third embodiment.

The third embodiment can obtain the effect similar to that of the first and second embodiments by the protrusion 20 alone which is provided in the upper part of the casing head sliding part 4*a* facing the crossbar head sliding part 9*a*, or in the lower part of the casing wall sliding part 4*b* facing the crossbar side wall sliding part 9*b* along the sliding direction of the crossbar 9.

Fourth Embodiment

A fourth embodiment of the present invention will now be described with reference to FIGS. 19 and 20. A component common to the first and fourth embodiments will be designated by the same reference numeral and described.

The fourth embodiment has a structure in which, in opening supply-side and load-side contact points, the distance between a fixed contact point 70*a* and a movable contact point 12*a* on the supply-side is longer than the distance between a fixed contact point 70*b* and a movable contact point 12*b* on the load-side. As illustrated in FIG. 19, a load-side fixed contact 7*b* is positioned toward a movable contact 12 by a distance C1 relative to the position of a supply-side fixed contact 7*a*. The distance C1 equals 0.6 mm, for example. Owing to this, even when a crossbar 9 on the side of a side wall is tilted in the direction of gravity with respect to the horizontal, it can be configured that a timing when the load-side movable contact point 12*b* contacts the load-side fixed contact point 70*b* is not delayed in comparison with a timing when the supply-side movable contact point 12*a* contacts the supply-side fixed contact point 70*a*.

The operation of the fourth embodiment will now be described.

Figure 19:
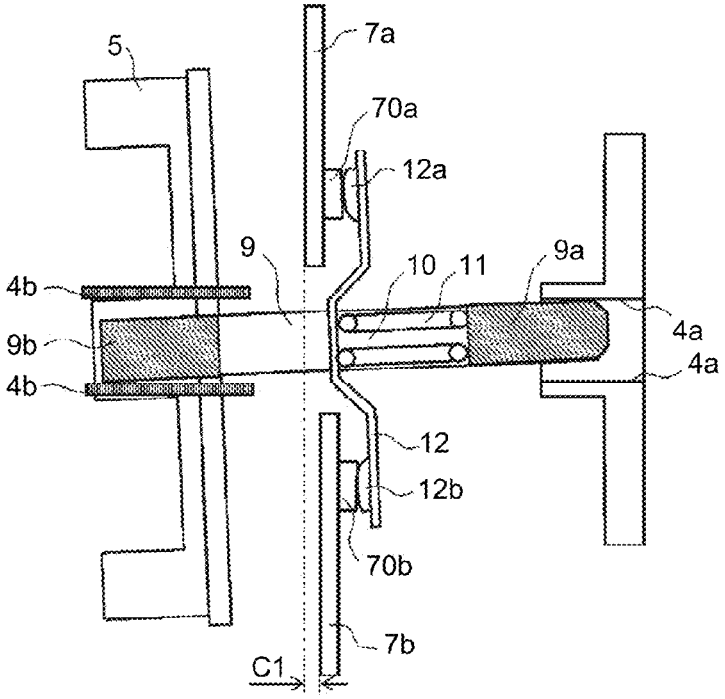
FIG. 19 is an enlarged view illustrating a movable part and a sliding part in closing contact points of an electromagnetic switch according to a fourth embodiment of the present invention.

As illustrated in FIG. 19, the load-side movable contact point 12*b* and the load-side fixed contact point 70*b* are electrically connected to each other no later than the electrical connection between the supply-side movable contact point 12*a* and the supply-side fixed contact point 70*a*, whereby a current starts flowing.

When the contact points are brought into contact with each other as illustrated in FIG. 19, the movable contact points 12*a* and 12*b* bounce back upon colliding with the fixed contact points 70*a* and 70*b*. At this time, the load-side movable contact point 12*b* and the load-side fixed contact point 70*b* are electrically connected to each other no later than the electrical connection between the supply-side movable contact point 12*a* and the supply-side fixed contact point 70*a*, so that the load-side movable contact point 12*b* has a higher contact pressure due to a pressing spring 11 than the supply-side movable contact point 12*a*. On the other hand, a movable core 5 disposed on the side of the side wall of the crossbar 9 is likely to cause a counterclockwise moment by the weight of the movable core 5 under the influence of gravity as illustrated in FIG. 8, thereby causing an increase in the contact pressure of the supply-side movable contact point 12*a* and a decrease in the contact pressure of the load-side movable contact point 12*b*. The distance between the load-side contact points is set shorter than the distance between the supply-side contact points as described above. Thus, it is able to offset the effect of the weight of the movable core 5 and allow the supply-side and load-side contact points to have equal contact pressure.

The supply-side movable contact point 12*a* and the load-side movable contact point 12*b* thus bounce equally to be subjected to erosion substantially equally, and thus extreme erosion of electrodes can be prevented.

Figure 20:
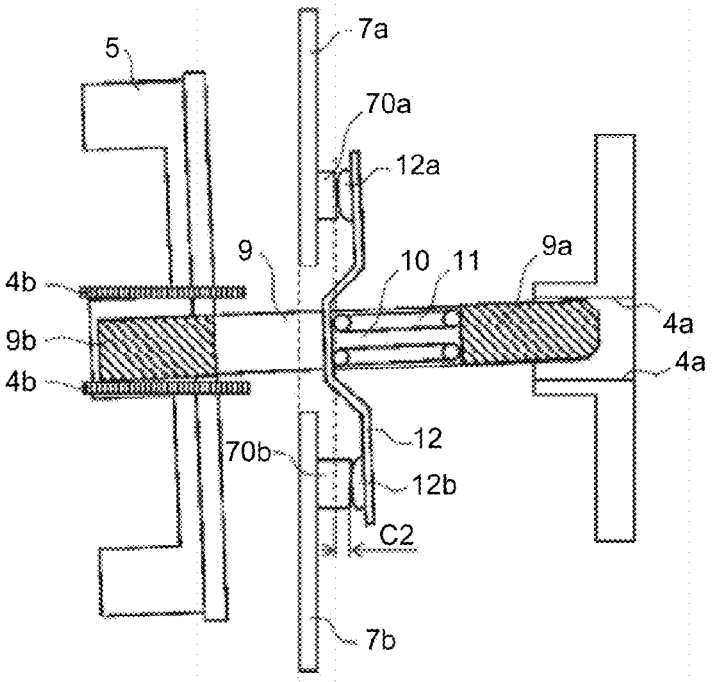
FIG. 20 is an enlarged view illustrating the movable part and the sliding part in closing the contact points of the electromagnetic switch according to the fourth embodiment of the present invention.

The fourth embodiment can obtain an effect similar to that of FIG. 19 by making the load-side fixed contact point 70*b* thicker than the supply-side fixed contact point 70*a* as illustrated in FIG. 20. The thickness may be increased by a value C2 similar to the value C1 by which the load-side fixed contact is shifted in FIG. 19.

The fourth embodiment can thus obtain the effect similar to that of the first to third embodiments. Note that the load-side movable contact point 12*b* may be connected to the load-side fixed contact point 70*b* at the same time the supply-side movable contact point 12*a* is connected to the supply-side fixed contact point 70*b*.

Fifth Embodiment

A fifth embodiment of the present invention will now be described with reference to FIGS. 21 to 23. A component common to the first and fifth embodiments will be designated by the same reference numeral and described.

Figure 21:
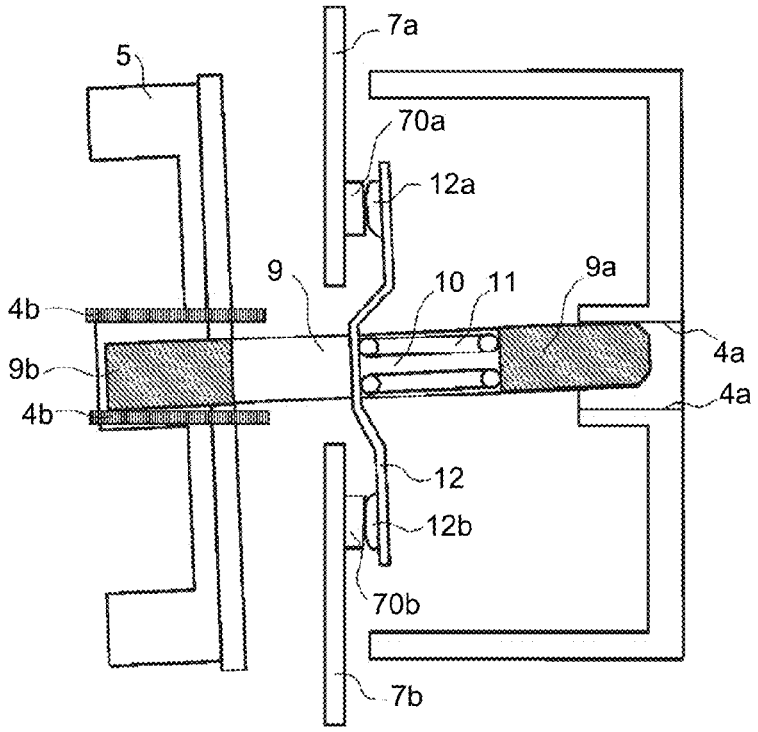
FIG. 21 is an enlarged view illustrating a movable part and a sliding part in closing contact points of an electromagnetic switch according to a fifth embodiment of the present invention.
Figure 22:
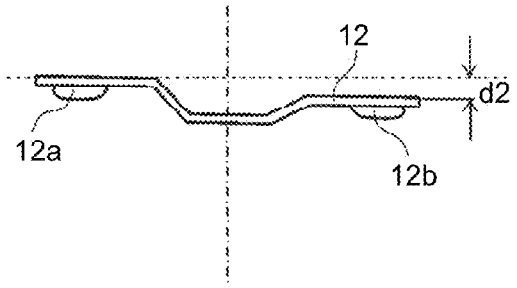
FIG. 22 is an enlarged view illustrating a shape of a movable contact in FIG. 21 according to the fifth embodiment of the present invention.
Figure 23:
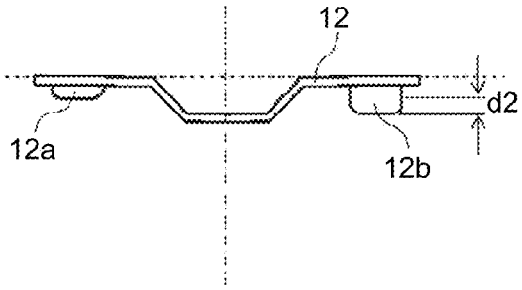
FIG. 23 is an enlarged view illustrating another shape of the movable contact of the electromagnetic switch according to the fifth embodiment of the present invention.

As with the fourth embodiment, the fifth embodiment has a structure as illustrated in FIGS. 21 to 23 in which, in opening supply-side and load-side contact points, the distance between a fixed contact point 70*a* and a movable contact point 12*a* on the supply-side is longer than the distance between a fixed contact point 70*b* and a movable contact point 12*b* on the load-side. Note that the fourth embodiment is adapted to adjust the above distance by changing the position of a fixed contact 7 or the thickness of the load-side fixed contact point 70*b*.

In the fifth embodiment, a movable contact 12 is disposed asymmetrically with respect to a central axis of a crossbar 9 oriented in the sliding direction thereof. That is, the fifth embodiment is characterized in that the movable contact 12 on the load-side is tilted clockwise as illustrated in FIG. 22, or the thickness of the load-side movable contact point 12*b* is increased as illustrated in FIG. 23. These structures can be adopted to adjust the distance between the contact points. The fifth embodiment will now be described with reference to FIGS. 21 and 22.

FIG. 21 is an enlarged view illustrating a movable part and a sliding part of the fifth embodiment in closing the supply-side and load-side contact points of an electromagnetic switch 100. As illustrated in FIG. 21, the movable contact 12 is structured asymmetrically with respect to the sliding direction of the crossbar 9, where the load-side of the contact is tilted clockwise. In such a structure, even when the crossbar 9 on the side of a movable core 5 is tilted in the direction of gravity with respect to the horizontal, it can be configured that a timing when the load-side movable contact point 12*b* contacts the load-side fixed contact point 70*b* is not delayed in comparison with a timing when the supply-side movable contact point 12*a* contacts the supply-side fixed contact point 70*a*.

FIG. 22 is an enlarged view illustrating the movable contact 12 of the electromagnetic switch in FIG. 21. The load-side movable contact point 12*b* is positioned away from a dotted reference line in FIG. 22 by a distance d2. Accordingly, the distance between the load-side movable contact point 12*b* and the fixed contact point 70*b* is shorter by the distance d2 than the distance between the supply-side movable contact point 12*a* and the fixed contact point 70*a*. Although varying from machine to machine, the angle of downward tilt of, for example, one degree of a crossbar side wall sliding part 9*b* on the side of the movable core 5 in FIG. 21 causes the load-side fixed contact point 70*b* and the movable contact point 12*b* to be separated from each other by approximately 0.6 mm at the time of operation. The distance d2 is thus set to 0.6 mm.

The operation of the fifth embodiment will now be described.

The above arrangement of the fifth embodiment allows the load-side movable contact point 12*b* to be electrically connected to the load-side fixed contact point 70*b* first, and thereafter allows the supply-side movable contact point 12*a* to be electrically connected to the supply-side fixed contact point 70*a*. The current starts flowing as a result.

The movable contact points 12*a* and 12*b* bounce back upon colliding when the contact points are brought into contact with each other. At this time, the load-side movable contact point 12*b* is electrically connected to the load-side fixed contact point 70*b* first and thus has a higher contact pressure due to a pressing spring 11 than the supply-side movable contact point 12*a*. On the other hand, the movable core 5 disposed on the side of a side wall of the crossbar 9 is likely to cause a counterclockwise moment due to the weight of the movable core 5 to thus result in an increase in the contact pressure of the supply-side movable contact point 12*a* and a decrease in the contact pressure of the load-side movable contact point 12*b*. The load-side movable contact point 12*b* is positioned closer to the corresponding fixed contact point than the supply-side movable contact points is at the time of opening of the contact points, whereby the effect of the weight of the movable core 5 can be offset to allow the supply-side and load-side contact points to have equal contact pressure.

According to the fifth embodiment, the supply-side movable contact point 12*a* and the load-side movable contact point 12*b* bounce equally to be subjected to erosion substantially equally. This can prevent extreme erosion of electrodes.

An increase in the thickness of the load-side movable contact point by d2 can also result in the effect that the supply-side contact points are connected no later than the connection of the load-side contact points. The value of d2 in this case equals 0.6 mm, for example.

The supply-side movable contact point 12*a* can also be disposed away from the corresponding fixed contact point 70*a* with respect to the load-side movable contact point 12*b*. An effect similar to the aforementioned effect can be obtained by, for example, disposing the supply-side movable contact point 12*a* away from the corresponding fixed contact point 70*a* by 0.6 mm with respect to the load-side movable contact point 12*b*.

Sixth Embodiment

A sixth embodiment of the present invention will now be described with reference to FIGS. 24 and 25. A component common to the first and sixth embodiments will be designated by the same reference numeral and described.

Figure 24:
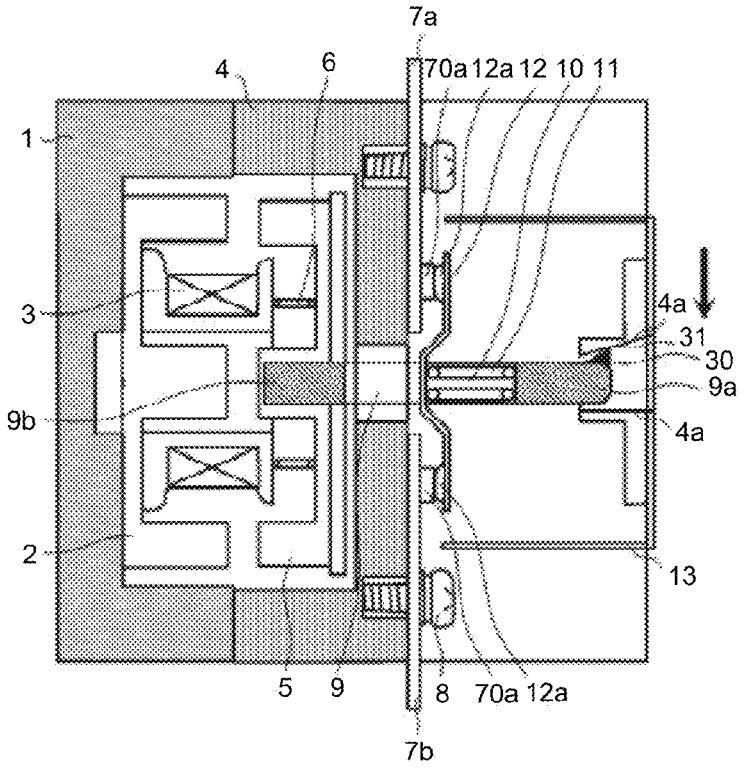
FIG. 24 is a sectional view illustrating the configuration of an electromagnetic switch according to a sixth embodiment of the present invention.

FIG. 24 is a view illustrating the structure of an electromagnetic switch 100 of the sixth embodiment in closing supply-side and load-side contact points of the electromagnetic switch 100. FIG. 24 illustrates the structure in which a slope 31 is provided on a wall surface of a casing head sliding part 4*a* on the supply-side, and a projection 30 is provided on a crossbar head sliding part 9*a* on the supply-side.

The projection 30 has the shape of a quadrangle, a triangular pyramid, or the like. The slope 31 is an inclined surface or a curved surface. Such a structure also allows a crossbar 9 to be held horizontally or allows the crossbar 9 on the side of a movable core 5 to be tilted in a direction opposite to the direction of gravity with respect to the horizontal, thereby bringing a load-side movable contact point 12*b* and a load-side fixed contact point 70*b* into contact with each other no later than the contact between a supply-side movable contact point 12*a* and a supply-side fixed contact point 70*a*.

In closing the contact points, the projection 30 provided on the crossbar head sliding part 9*a* and brought into contact with the slope 31 of the corresponding casing head sliding part 4*a* allows for a certain amount of clearance between the crossbar head sliding part 9*a* and the casing head sliding part 4*a*.

The projection 30 is brought into contact with the slope 31 of the casing head sliding part 4*a* only at the time of closing of the contact points so that the crossbar 9 can move smoothly at the time of opening and closing of the contact points. In closing the contact points, the projection 30 of the crossbar head sliding part 9*a* provides support not in a direction perpendicular to the direction of movement of the crossbar 9 but at an angle. This prevents the crossbar head sliding part 9*a* from being stuck and locked in the casing head sliding part 4*a*.

Figure 25:
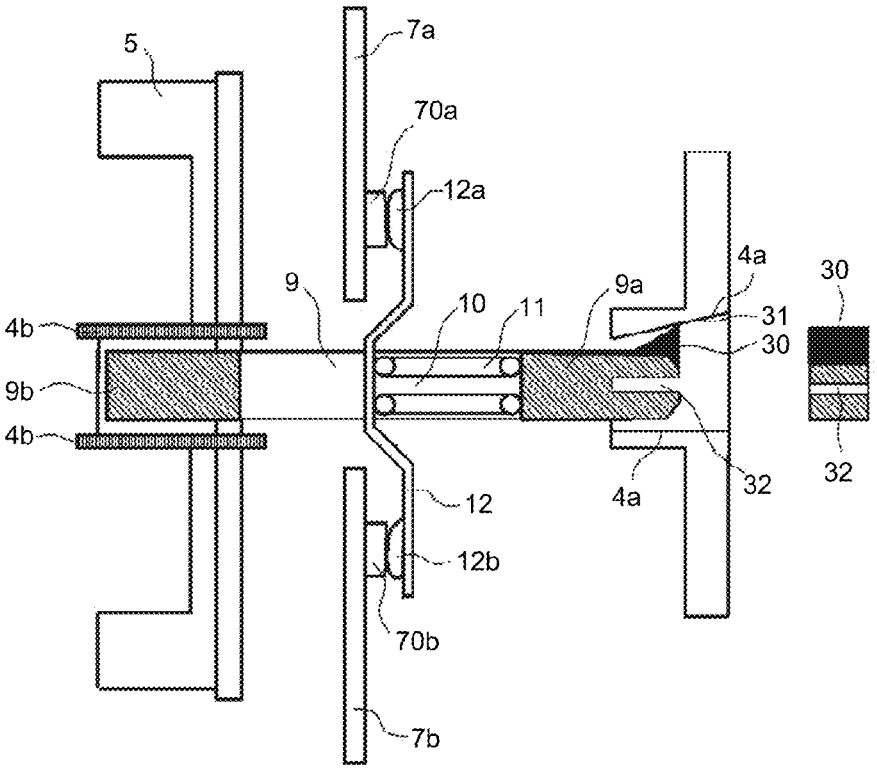
FIG. 25 is an enlarged view illustrating a movable part and a sliding part in closing contact points of the electromagnetic switch according to the sixth embodiment of the present invention.

FIG. 25 is a view illustrating a movable part and a sliding part of the sixth embodiment in closing the supply-side and load-side contact points of the electromagnetic switch 100. A groove 32 is further provided horizontally in the crossbar head sliding part 9*a* as illustrated in FIG. 25. Such a groove provides elasticity to the crossbar head sliding part 9*a* and mitigates the impact when the projection 30 of the crossbar head sliding part is brought into contact with the casing head sliding part 4*a* corresponding to the projection 30. This results in less bouncing of the supply-side movable contact point 12*a* and the load-side movable contact point 12*b*.

An effect similar to the aforementioned effect can be obtained by attaching, to the projection 30, a spring or the like that provides elasticity instead of the groove 32 provided in the crossbar head sliding part 9*a*.

In addition to the projection 30 provided in the upper part of the crossbar head sliding part 9*a* and the groove 32 provided horizontally therein, the crossbar head sliding part 9*a* may be provided with a projection 30 on each of both side surfaces thereof and a groove 32 along the direction of gravity. This not only allows the movable contact points 12*a* and 12*b* to be equally brought into contact with the corresponding fixed contact points 70*a* and 70*b* but reduces bouncing of the contact points of electrodes in each of three phases.

The sixth embodiment can obtain the effect similar to that of the first to fifth embodiments.

Although the projection 30 is provided in the upper part of the crossbar head sliding part 9*a* while the slope 31 is provided in the lower part of the casing head sliding part 4*a* in the sixth embodiment, the projection and the slope may each be provided at another site. The projection 30 may be provided in a lower part of a crossbar side wall sliding part 9*b*, and the slope 31 may be provided in a lower part of a casing wall sliding part 4*b*. As a result, in the sixth embodiment, the contact between the projection 30 and the slope 31 causes the crossbar 9 on the side of the movable core 5 to be tilted in the direction opposite to the direction of gravity with respect to the horizontal.

Effects similar to the aforementioned effects can be obtained by any combination of the structures and the arrangements of the first to sixth embodiments.

INDUSTRIAL APPLICABILITY

The present invention can be applied to an electromagnetic switch, an electromagnetic contactor, a relay, or a breaker.

REFERENCE SIGNS LIST

100 electromagnetic switch, 1 mount, 2 fixed core, 3 operating coil, 4 casing, 4*a* casing head sliding part, 4*b* casing wall sliding part, 5 movable core, 6 trip trip spring, 7 fixed contact, 7*a* supply-side fixed contact, 7*b* load-side fixed contact, 70*a* supply-side fixed contact point, 70*b* load-side fixed contact point, 8 terminal screw, 9 crossbar, 9*a* crossbar head sliding part, 9*b* crossbar side wall sliding part, 10 rectangular window, 11 pressing spring, 12 movable contact, 12*a* supply-side movable contact point, 12*b* load-side movable contact point, 13 arc cover, 20 protrusion, 30 projection, 31 slope, 32 groove.

The invention claimed is:

1. An electromagnetic switch comprising:

a movable core to be attracted to or separated from a fixed core by an electromagnet;

a crossbar to include the movable core at an end and to slide integrally with the movable core in a direction of attraction or separation between the movable core and the fixed core;

a casing sliding part to allow the crossbar to slide;

a pair of movable contact points to operate in conjunction with sliding of the crossbar and be provided at positions to oppose each other with respect to a central axis of the crossbar along a sliding direction of the crossbar; and a pair of fixed contact points to be provided at positions facing the movable contact points, wherein the crossbar includes a first crossbar sliding part and a second crossbar sliding part, the casing sliding part includes a first casing sliding part to allow the first crossbar sliding part to slide, and a second casing sliding part to allow the second crossbar sliding part to slide, and the first crossbar sliding part is brought into contact with the first casing sliding part, or the second crossbar sliding part is brought into contact with the second casing sliding part to cause the crossbar on a side of the movable core to be tilted in a direction opposite to a direction of gravity with respect to the horizontal.

2. The electromagnetic switch according to claim 1, wherein the first crossbar sliding part is a crossbar head sliding part being one end of the crossbar, the second crossbar sliding part is a crossbar side wall sliding part provided toward the movable core with respect to the crossbar head sliding part, the first casing sliding part is a casing head sliding part allowing the crossbar head sliding part to slide, the second casing sliding part is a casing wall sliding part allowing the crossbar side wall sliding part to slide, and the casing wall sliding part is disposed at a position to cause a lower part of the crossbar side wall sliding part to be tilted in the direction opposite to the direction of gravity with respect to the horizontal.

3. The electromagnetic switch according to claim 1, wherein the first crossbar sliding part is a crossbar head sliding part being one end of the crossbar, the second crossbar sliding part is a crossbar side wall sliding part provided toward the movable core with respect to the crossbar head sliding part, the first casing sliding part is a casing head sliding part allowing the crossbar head sliding part to slide, the second casing sliding part is a casing wall sliding part allowing the crossbar side wall sliding part to slide, and the casing head sliding part is disposed at a position to cause an upper part of the crossbar head sliding part to be tilted in the direction of gravity with respect to the horizontal.

4. The electromagnetic switch according to claim 1, wherein the first crossbar sliding part is a crossbar head sliding part being one end of the crossbar, the second crossbar sliding part is a crossbar side wall sliding part provided toward the movable core with respect to the crossbar head sliding part, the first casing sliding part is a casing head sliding part allowing the crossbar head sliding part to slide, the second casing sliding part is a casing wall sliding part allowing the crossbar side wall sliding part to slide, and a protrusion is provided in an upper part of the casing head sliding part facing the crossbar head sliding part or in a lower part of the casing wall sliding part facing the crossbar side wall sliding part, with respect to the sliding direction of the crossbar.

5. The electromagnetic switch according to claim 1 wherein, when the movable core is attracted to the fixed core, one of the movable contact points is brought into contact with one of the fixed contact points in a way that centers of the contact points are aligned with each other, and another one of the movable contact points is brought into contact with another one of the fixed contact points in a way that center of the contact points are aligned with each other.

6. An electromagnetic switch comprising:

a movable core to be attracted to or separated from a fixed core by an electromagnet;

a crossbar to slide integrally with the movable core in a direction of attraction or separation between the movable core and the fixed core;

a casing sliding part to allow the crossbar to slide;

a pair of upper and lower movable contact points to be provided at opposing positions on upper and lower sides with respect to a central axis of the crossbar along a sliding direction of the crossbar, and operate in conjunction with sliding of the crossbar; and a pair of upper and lower fixed contact points to be brought into contact with the upper and lower movable contact points by a movement of the movable contact points, wherein the crossbar includes a crossbar head sliding part being one sliding end of the crossbar in the sliding direction of the crossbar, and a crossbar side wall sliding part being another sliding end of the crossbar disposed on a side of the movable core, the casing sliding part includes a casing head sliding part to allow the crossbar head sliding part to slide, and a casing wall sliding part to allow the crossbar side wall sliding part to slide, and when the movable core is separated from the fixed core, a distance between the lower movable contact point and the lower fixed contact point that are in contact with each other is shorter than a distance between the upper movable contact point and the upper fixed contact point that are in contact with each other.

7. The electromagnetic switch according to claim 6 wherein, with positions of the upper and lower movable contact points being fixed when the movable core is separated from the fixed core, the distance between the lower fixed contact point and the lower movable contact point is shorter than the distance between the upper fixed contact point and the upper movable contact point.

8. The electromagnetic switch according to claim 6 wherein, with positions of the upper and lower fixed contact points being fixed when the movable core is separated from the fixed core, the distance between the lower fixed contact point and the lower movable contact point is shorter than the distance between the upper fixed contact point and the upper movable contact point.

9. The electromagnetic switch according to claim 6, wherein the fixed contact point below the crossbar is thicker than the fixed contact point above the crossbar.

10. The electromagnetic switch according to claim 6, wherein the movable contact point below the crossbar is thicker than the movable contact point above the crossbar.

11. An electromagnetic switch comprising:

a movable core to be attracted to or separated from a fixed core by an electromagnet;

a crossbar to slide integrally with the movable core in a direction of attraction or separation between the movable core and the fixed core;

a casing sliding part to allow the crossbar to slide;

a pair of movable contact points to operate in conjunction with sliding of the crossbar and be provided at positions to oppose each other with respect to a central axis of the crossbar along a sliding direction of the crossbar; and a pair of fixed contact points to be provided at positions facing the movable contact points, wherein the crossbar includes a first crossbar sliding part and a second crossbar sliding part, the casing sliding part includes a first casing sliding part to allow the first crossbar sliding part to slide, and a second casing sliding part to allow the second crossbar sliding part to slide, the first crossbar sliding part or the second crossbar sliding part includes a projection, the first casing sliding part or the second casing sliding part includes a slope to slide with respect to the projection, and the projection and the slope are brought into contact with each other to cause the crossbar on a side of the movable core to be tilted in a direction opposite to a direction of gravity with respect to the horizontal.

12. The electromagnetic switch according to claim 11, wherein the first crossbar sliding part or the second crossbar sliding part includes a groove along the sliding direction of the crossbar.

13. The electromagnetic switch according to claim 11, wherein the projection is an elastic member.

* * * * *